US011339568B2

(12) United States Patent
Ustinov

(10) Patent No.: US 11,339,568 B2
(45) Date of Patent: May 24, 2022

(54) CONSTRUCTION SYSTEM FOR A MODULE OF A BUILDING

(71) Applicant: Igor Ustinov, Lausanne (CH)

(72) Inventor: Igor Ustinov, Lausanne (CH)

(73) Assignee: UHCS PROPERTY SA, Sion (CH)

( * ) Notice: Subject to any disclaimer, the term of this patent is extended or adjusted under 35 U.S.C. 154(b) by 0 days.

(21) Appl. No.: 17/048,181

(22) PCT Filed: Apr. 16, 2019

(86) PCT No.: PCT/IB2019/053126

§ 371 (c)(1),
(2) Date: Oct. 16, 2020

(87) PCT Pub. No.: WO2019/202498

PCT Pub. Date: Oct. 24, 2019

(65) Prior Publication Data

US 2021/0156142 A1 May 27, 2021

(30) Foreign Application Priority Data

Apr. 17, 2018 (CH) ..... 00493/18

(51) Int. Cl.
*E04B 2/56* (2006.01)
*E04B 5/02* (2006.01)

(52) U.S. Cl.
CPC ..... *E04B 2/56* (2013.01); *E04B 5/026* (2013.01)

(58) Field of Classification Search
CPC ..... E04B 2/56; E04B 5/026; E04B 1/5806; E04B 1/34326; E04B 2001/5881; E04B 1/18; E04C 2003/0417; E04C 2003/0421; E04C 2003/0439; E04C 2003/0465; E04C 2003/0434; E04C 2003/0478; E04C 3/30
See application file for complete search history.

(56) References Cited

U.S. PATENT DOCUMENTS 3,836,218 A * 9/1974 Hallal ..... A47B 47/0041 312/111
4,562,427 A * 12/1985 Ecton ..... G05B 19/045 326/46
4,652,170 A * 3/1987 Lew ..... E04B 1/617 403/381
5,477,594 A * 12/1995 LePage ..... E04H 13/006 211/194

(Continued)

*Primary Examiner* — Patrick J Maestri

(57) ABSTRACT

The invention proposes a system for constructing a module of a building, including core construction elements (1) that are surrounded by the surrounding construction elements (2A, 2B). The core construction elements (1) each include, in section, a cross including two main arms (6) of equal length which intersect at mid-length at right angle. Each core construction element (1) has a plane of symmetry about the axes of the arms. The main arms (6) of the cross terminate, at the ends thereof, with transverse portions (7). Each surrounding construction element (2A, 2B) is composed of four partial surrounding parts (2A, 2B, 2A', 2B') of a generally triangular shape which are assembled around a core element (1). Construction elements forming junction parts (4A, 4B) allow assembling panels (4A, 4B) to form a module of a building in the form of a rectangular parallelepiped volume comprising four corners.

16 Claims, 7 Drawing Sheets

(56) References Cited

U.S. PATENT DOCUMENTS

| | | | | |
|---|---|---|---|---|
| 6,557,955 | B2 * | 5/2003 | Saravis | A47B 47/0033 312/111 |
| D586,480 | S * | 2/2009 | Hockemeyer | D25/126 |
| 2004/0178704 | A1 | 9/2004 | Saravis | |
| 2014/0339018 | A1 * | 11/2014 | Blinn | E04G 21/3247 182/82 |

* cited by examiner

CONSTRUCTION SYSTEM FOR A MODULE OF A BUILDING

The present invention relates to a construction system for a module of a building, in particular a dwelling or a garage, whose main elements can be made of plastic material, in particular recycled plastic material or recycled wood.

WO2016016706 describes a construction system including a set of accessory elements and a set of bodies of elongated shape for making a construction by assembling a plurality of said bodies with accessory elements. The body of elongated shape includes a front face and a rear face, which are planar and opposite, an upper face and a lower face, which are planar and opposite, and two opposite lateral faces. At least one of said two lateral faces has a recessed portion, in particular a curvature on the central portion thereof. Each body can be assembled with another body, by their lateral faces therebetween and/or by the assembly of a lower face of one body on the upper face of another body and/or by the assembly of a lateral face of one body with the front or rear face of another body.

CH714202 in the name of the applicant and which is not published describes a construction system for a module of a building, in particular a dwelling or a garage, whose main elements are made of a plastic material, including a set of extruded, hollow profile main beams, of an elongated rectilinear shape, of a uniform section and of an adequate length. These main beams can be assembled end-to-end to form a rectangular open structure in the shape of a 3-dimensional rectangular frame. The construction system further includes a plurality of intermediate secondary beams, which can be assembled between parallel and opposite main beams of a rectangular frame, and a plurality of flat facade elements insertable against each other between two adjacent parallel beams, each facade element including a rectangular flat plate provided with two folded opposite edges that can be hooked with adjacent parallel beams.

WO 93/23631 describes a joint between the face-to-face ends of horizontal wooden elements, this joint including a cruciform part provided with T-shaped heads.

GB 1 336 991 describes a cruciform joint provided with four T-shaped projections for the connection of horizontal rails.

US 2004/0178704 describes at FIG. 12 a device for connecting four panels at right angles, the connection device comprising a central core in the form of a plain cross whose ends engage in grooves formed in parts at the ends of the four panels, which parts come to interengage with the adjacent parts when the panels are inserted. This device enables the assembly of the panels by encasement in an orthogonal configuration.

The present invention allows a construction system to be made for a module of a building whose main elements can be made of plastic material, in particular of recycled plastic material or recycled wood, allowing a robust construction using a reduced number of standardized portions to constitute the construction elements.

In accordance with the invention, this aim is achieved thanks to a system for constructing a module of a building, including core construction elements and surrounding construction elements of the core elements.

The inventive system therefore includes a plurality of core construction elements which each includes, in section, a cross including two main arms of equal length, the main arms intersecting at mid-length at a right angle. Each core construction element has a plane of symmetry about the axes of each main arm. The main arms of the cross terminate, at the ends thereof, in transverse portions whose length is less than the length of the main arms.

The inventive system also includes a plurality of surrounding construction elements of the core elements, where each surrounding element is composed of four partial surrounding parts which are assembled around a core element, unlike the provisions of WO 93723631 and GB 1 336 991.

The partial surrounding parts each have a section essentially of an isosceles right triangle including a long side and two inclined sides that form a right angle. The four partial surrounding parts once assembled are disposed with their long side outwards and with the inclined sides terminating with the right angle inwards towards the center of the cross of a core element. The four partial surrounding parts thus form a square surrounding the cross of the core element. Also, the triangular partial surrounding parts include openings and/or cutouts that surround the principal arms and the transversal parts of the cross of the core element.

The core construction elements are rectilinear elongated bodies of a cross-shaped section that are surrounded along their length by the surrounding construction elements, also allowing a right-angled assembly.

Thus, with the inventive system, and unlike the state of the art, constructions can be done in 6 directions (up, down, left, right, front, rear).

The main arms of the cross of a core element terminate, at the ends thereof, with transverse projections. In this manner, the cross of a core element is a cross potent whose main arms are terminated, at the ends thereof, with T-shaped transverse projections.

Typically, when the cross has a dimension L in the direction of the main arms, and the lateral projections have a length t, the ratio L:t=2.5-3, preferably 2.6-2.75.

Also typically, where the main arms and T-shaped transverse portions of a cross potent have a uniform thickness e, a length t=(1.5-4)e, preferably (2.5-3.5)e, for example t=3e, and the dimension L=(6-10)e, preferably (7-9)e, for example L=8e.

In one embodiment, the surrounding elements are each composed of four partial surrounding portions that have cutouts in the inclined sides thereof so that the cutouts of two side-by-side triangular partial surrounding portions correspond to a main arm of the cross with its transverse projections. In this manner, the arms of the cross are disposed along the diagonals of the square formed by the four assembled partial surrounding portions.

Another embodiment includes surrounding elements each composed of four triangular-shaped partial surrounding portions which each have, inside each triangular partial surrounding portion, openings in the shape of a main arm of the cross extending from the right angle of the triangle with its transverse projections in front of the long side of the triangle. In this manner, the main arms of the cross and the optional T-shaped portions are disposed parallel to the sides of the square formed by the four assembled partial surrounding portions.

Each surrounding element can be made of a single part, possibly with openings, or can be constituted by assembling at least two parts, advantageously leaving spaces.

The invention also concerns an assembly including a core element surrounded by surrounding elements each formed by the assembly of several parts, the assembly including an outer wall formed by outer portions of the assembled parts disposed in parallel and adjacent rows extending along the outer wall.

The system according to the invention usually includes a plurality of core construction elements and a plurality of surrounding construction elements of the core elements, each in several standardized lengths.

The system according to the invention preferably includes a plurality of construction elements forming junction parts including a hollow body of an approximately rectangular shape in section. In this case, one side of this hollow body is secured with a triangular shape which corresponds with one of said triangular-shaped partial surrounding portions of the surrounding construction elements, allowing these junction parts to be assembled around a core construction element. The side of the hollow body of a junction part opposite to said side that is secured with the triangular shape is advantageously provided with a profile adapted for the assembly of a panel.

The hollow bodies of the junction parts are for example intended for wiring, piping, insulation or even for reinforcement by filling with hardened earth or cement, for example.

The invention also concerns a module of a building constructed with the described system, the module comprising a plurality of core construction elements assembled with partial surrounding portions and junction parts.

For example, one embodiment of a module of a building according to the invention is in the form of a rectangular parallelepiped volume comprising four corners. Each corner comprises a vertically disposed core construction element, two faces of which, forming an external right angle at the corner, are closed by partial surrounding portions of surrounding elements, and two faces of which forming an internal right angle are assembled with junction parts, the outer sides of said hollow body of the junction parts supporting panels forming a facade.

According to a development of this embodiment of a module of a building, where at least two opposite sides of the rectangular parallelepiped volume each include a plurality n of intermediate core construction elements disposed vertically between the core construction elements disposed at the corners, the intermediate core construction elements support on two opposite faces in the plane on the side of the junction parts supporting n+1 panels.

The module of a building according to the invention preferably includes a floor or ceiling unit comprising a rectangular frame formed of horizontally disposed elongated core construction elements, outwardly closed by partial surrounding portions and inwardly closed by junction parts supporting a floor or ceiling.

Thanks to the construction system according to the invention, it is possible to construct an element of a building, for instance, a garage, a house using a limited number of construction elements made from recycled materials which construction elements are composed of standardized parts allowing a universal use for different configurations.

The features of the invention will appear more clearly on reading the following description of several embodiments given only by way of example, with reference to the schematic figures, in which.

The invention proposes a system for constructing a module of a building, including core construction elements 1 and surrounding construction elements 2 that surround the core elements.

Figure 1:
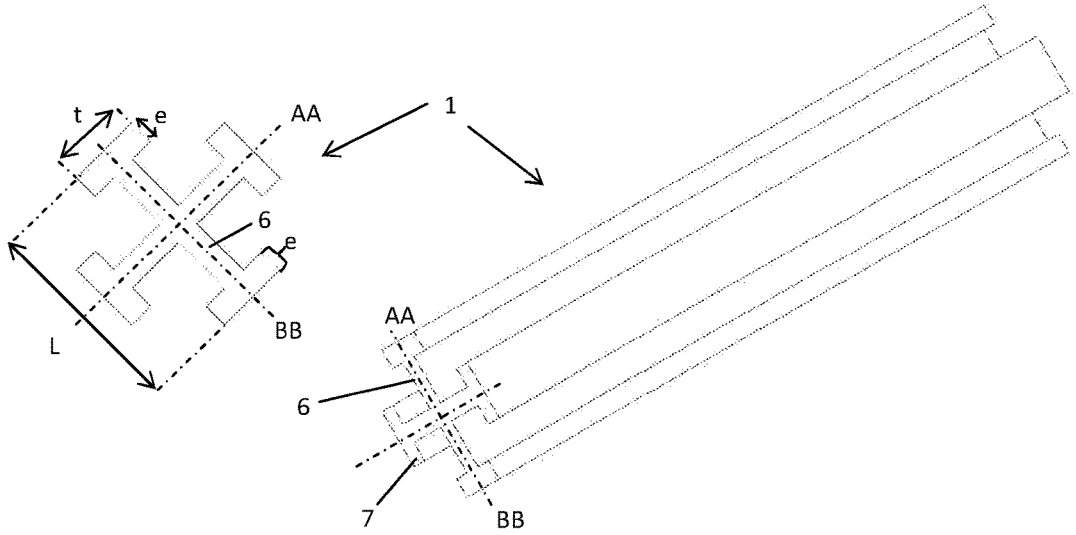
FIG. 1 is a sectional view and a perspective view of a construction element.

The inventive system therefore includes a plurality of core construction elements 1, FIG. 1, each of which includes, in section, a cross including two main arms 6 of equal length. The main arms 6 intersect at mid-length at a right angle. Each core construction element 1 has a plane of symmetry about the axes AA and BB of each main arm 6. The main arms 6 of the cross terminate, at the ends thereof, with transverse portions 7 whose length is less than the length of the main arms 6.

The inventive system also includes a plurality of surrounding construction elements 2 that surround the core elements 1, where each surrounding element 2 is composed of four partial surrounding parts 2A, 2B, 2A', 2B' which are assembled around a core element (FIG. 1).

The partial surrounding parts 2A, 2B, 2A', 2B' each have a section essentially of an isosceles right triangle including a long side 10 and two inclined sides 11 which form a right angle. The four partial surrounding parts 2A, 2B, 2A', 2B' once assembled are disposed with their long side 10 outwards and with the inclined sides 11 terminating in a right angle inwards towards the center of the cross of a core element 1. The four partial surrounding parts thus form a square that surrounds the cross of the core element 1 (FIG. 1). Also, the triangular partial surrounding parts 2A, 2B, 2A', 2B' include openings 12 (FIGS. 2B and 3B) and/or cutouts 13 (FIGS. 2A and 3A) which surround the cross of the core element 1.

The main arms 6 of the cross of a core element 1 terminate, at the ends thereof, with transverse projections. The cross of a core element 1, which is illustrated in FIG. 1, is a cross potent whose main arms 6 are terminated, at the ends thereof, in T-shaped transverse projections 7.

Typically, when the cross has a dimension L in the direction of the main arms 6, and the lateral projections have a length t, the ratio L:t=2.5-3, preferably 2.6-2.75.

Also typically, where the main arms 6 and T-shaped transverse portions 7 of a cross potent have a uniform thickness e, the length t=(1.5-4)e, preferably (2.5-3.5)e, for example t=3e, and the dimension L=(6-10)e, preferably (7-9)e, for example L=8e.

In addition to the shape of a cross potent with T-shaped ends, variant cross shapes are provided, for example with rounded, inclined or triangular-shaped ends. The important point is to keep the symmetry according to two perpendicular planes.

Figure 2A:
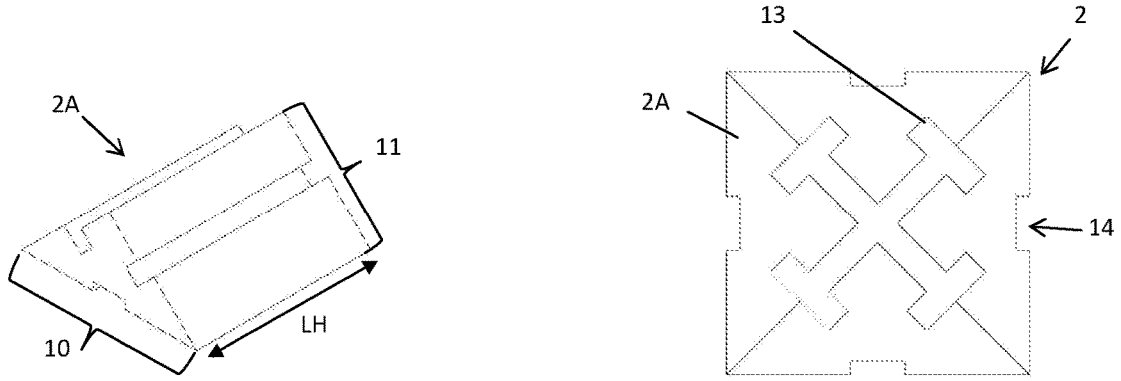
FIGS. 2A and 2B represent perspective and sectional views of surrounding construction elements of the core elements.

In the embodiment illustrated in FIG. 2A, the surrounding elements 2 are each composed of four partial surrounding portions 2A which have cutouts 13 in the inclined sides 11 thereof so that the cutouts 13 of two side-by-side triangular partial surrounding portions 2A correspond to a main arm 6 of the cross with its optional transverse projections 7. In this manner, the arms 6 of the cross are disposed along the diagonals of the square formed by the four assembled partial surrounding portions 2A.

Figure 2B:
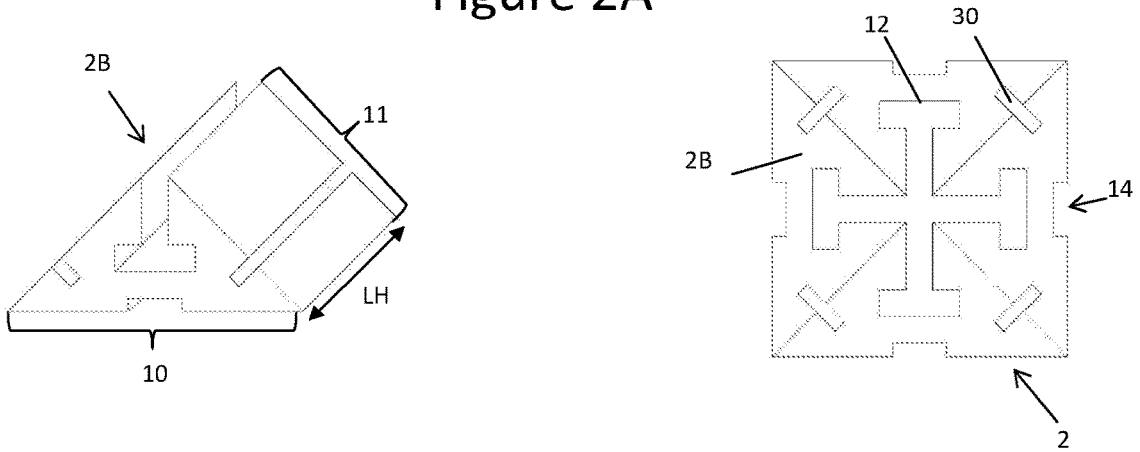

Another embodiment illustrated in FIG. 2B includes surrounding elements 2 each composed of four triangular-shaped partial surrounding parts 2B which each have, inside each triangular partial surrounding portion 2B', openings 12 in the shape of a main arm 6 of the cross extending from the right angle of the triangle with its optional transverse projections in front of the long side 10 of the triangle. In this manner, the main arms 6 of the cross and the optional T-shaped portions 7 are disposed parallel to the sides of the square formed by the four assembled partial surrounding portions 2B.

Figure 3A:
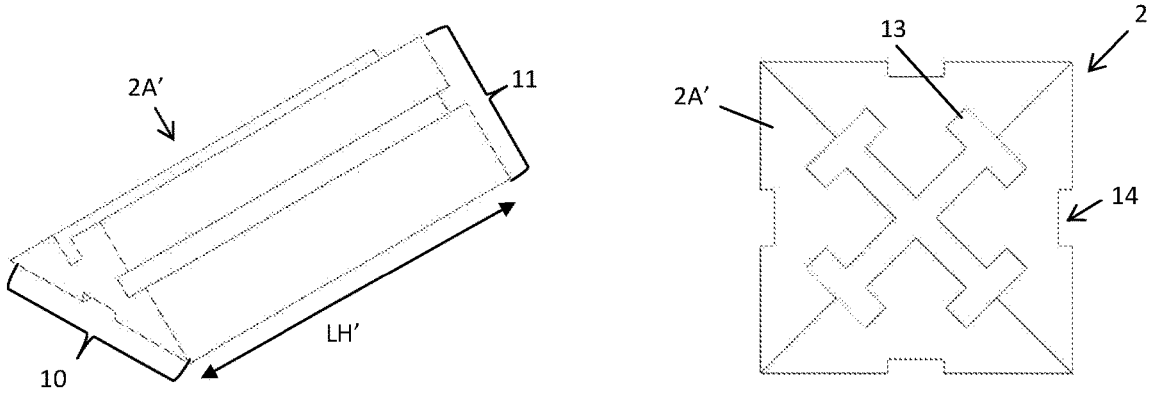
FIGS. 3A and 3B represent perspective and sectional views of construction elements.

In the embodiment illustrated in FIG. 3A, the surrounding elements 2 are each composed of four partial surrounding parts 2A' which have cutouts 13 in the inclined sides 11 thereof so that the cutouts 13 of two side-by-side triangular partial surrounding parts 2A' correspond to a main arm 6 of the cross with its optional transverse projections 7. In this manner, the arms 6 of the cross are disposed along the diagonals of the square formed by the four assembled partial surrounding parts 2A'.

Figure 3B:
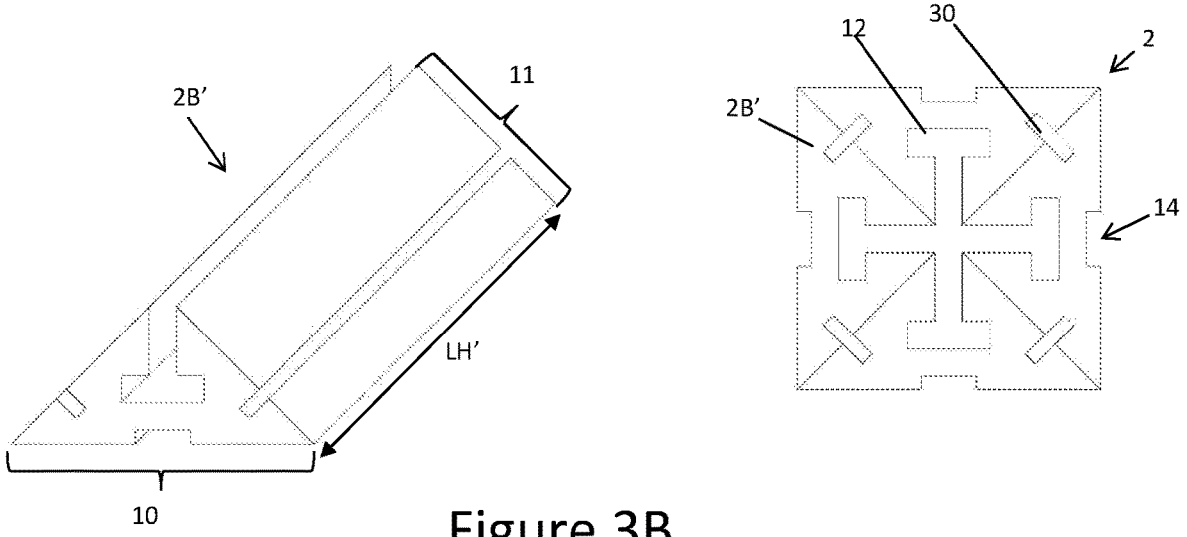

Another embodiment illustrated in FIG. 3B includes surrounding elements 2 each composed of four triangular-shaped partial surrounding parts 2B' which each have, inside each triangular partial surrounding portion 2B', openings 12 in the shape of a main arm 6 of the cross extending from the right angle of the triangle with its transverse projections in front of the long side 10 of the triangle. In this manner, the main arms 6 of the cross and the T-shaped portions 7 are disposed parallel to the sides of the square formed by the four assembled partial surrounding parts 2B.

The difference between the surrounding elements 2 of FIGS. 2A, 2B, 3A and 3B is the length LH, LH' of each of these parts. Indeed, in the examples illustrated in FIGS. 2A and 2B the length LH of the surrounding elements is for example 22 cm while in FIGS. 3A and 3B the length LH' of the surrounding elements is for example 100 cm.

As illustrated in FIGS. 2A, 2B, 3A, 3B, the inclined sides 11 of the partial surrounding parts 2A, 2B, 2A', 2B' include central grooves 14 which face each other when the partial surrounding parts 2A, 2B, 2A', 2B' are assembled around a core construction element 1. These central grooves 14 are arranged to receive reinforcing parts to secure the assembly.

The system according to the invention usually includes a plurality of core construction elements 1 and a plurality of surrounding construction elements 2 of the core elements, each of a standard length or in several standardized lengths.

As illustrated in FIGS. 2B and 3B, the surrounding elements 2 are each composed of four triangular-shaped partial surrounding parts 2B, 2B' which have studs 30 on the adjacent sides of two side-by-side triangles.

In a variant which is not illustrated, these studs 30 may be sufficient to connect four surrounding elements 2B, 2B' without the need for having a cross-shaped core which could even, in this version, facilitate the construction of surrounding elements insofar as it would be possible to construct surrounding elements with or without opening for the cores.

Figure 4A:
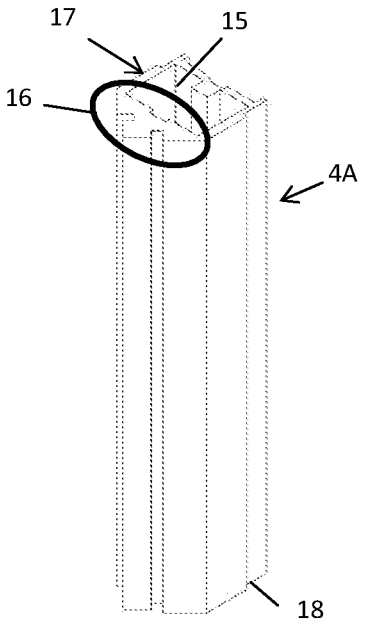
FIGS. 4A, 4B represent perspective views of construction elements forming junction parts.
Figure 4B:
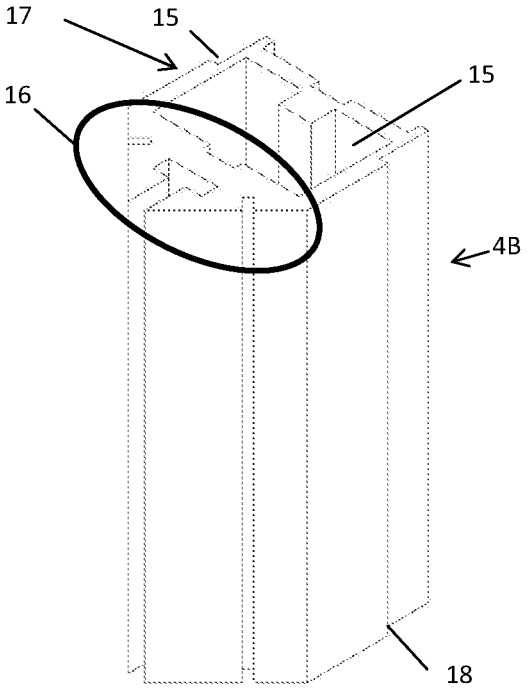

FIGS. 4A, 4B illustrate a construction element forming junction parts 4A, 4B including a hollow body 15 of an approximately rectangular shape in section. In this case, one side of this hollow body 15 is secured with a triangular shape 16 which corresponds with one of said triangular-shaped partial surrounding parts 2A, 2B of the surrounding construction elements 2, allowing these junction parts 4A, 4B to be assembled around a core construction element 1. The outer side 17 of the hollow body 15 of a junction part 4A, 4B opposite to said side that is secured with the triangular shape 16 is advantageously provided with a profile 18 adapted for the assembly of a panel 19 (FIG. 6).

The hollow body 15 is intended for example to receive wiring or piping. It can also contribute to insulation or even reinforcement by filling with hardened earth or cement, for example.

The invention also concerns a module of a building 9 constructed with the described system, the module comprising a plurality of core construction elements 1 which are assembled with partial surrounding parts 2A, 2B, 2A', 2B' and junction parts 4A, 4B.

Figure 6:
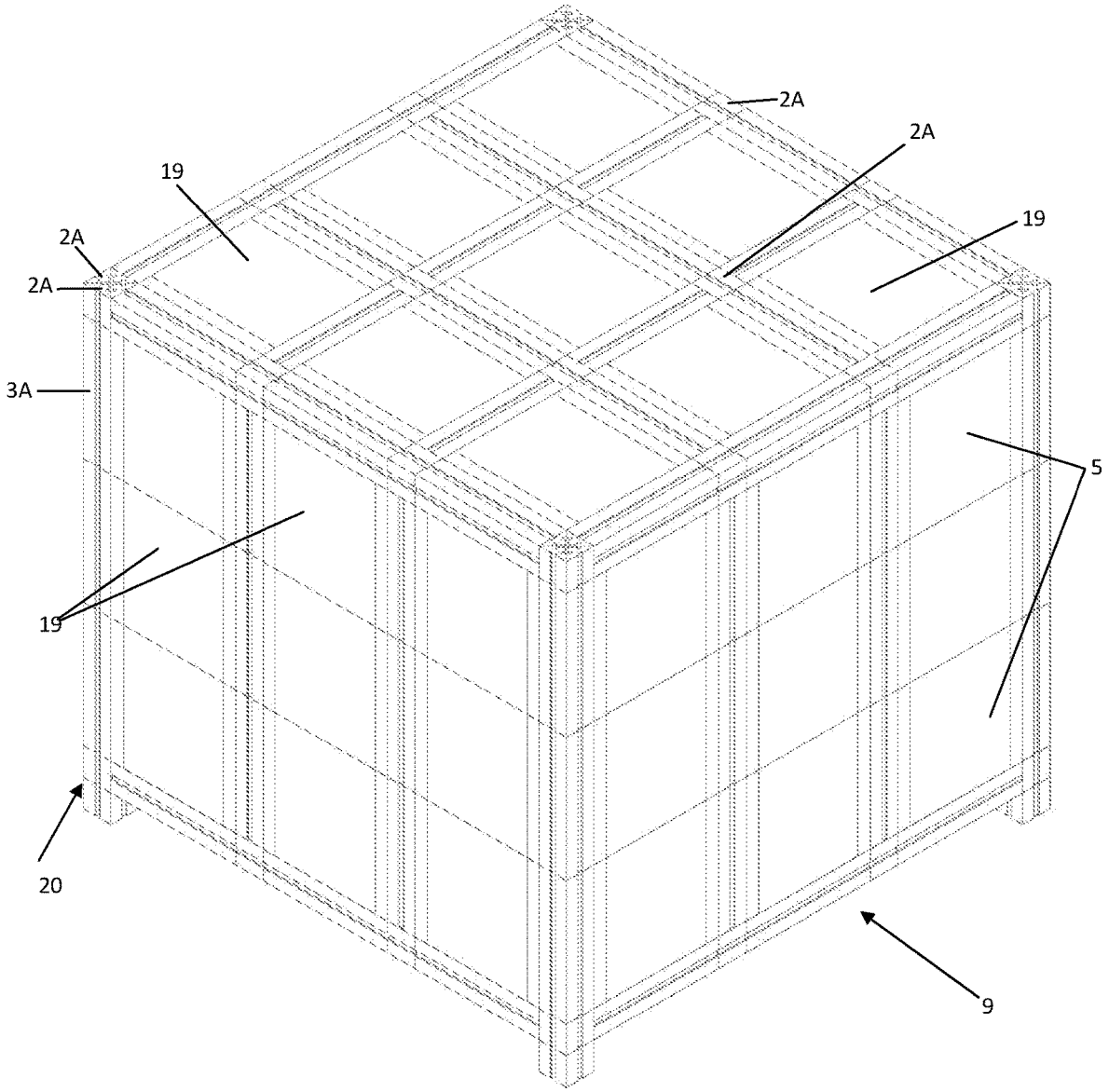
FIG. 6 represents a perspective view of an assembled construction module.

For example, one embodiment of a module of a building 9 according to the invention which is illustrated in FIG. 6 is in the form of a rectangular parallelepiped volume comprising four corners 20, each corner 20 comprises a vertically disposed core construction element 1, two faces of which, forming an external right angle at the corner 20, are closed by partial surrounding parts 2A, 2A' of surrounding elements, and two faces of which forming an internal right angle are assembled with junction parts 4A. The outer sides 17 of said hollow body of the junction parts 4A supporting panels 19 form a façade.

Figure 5:
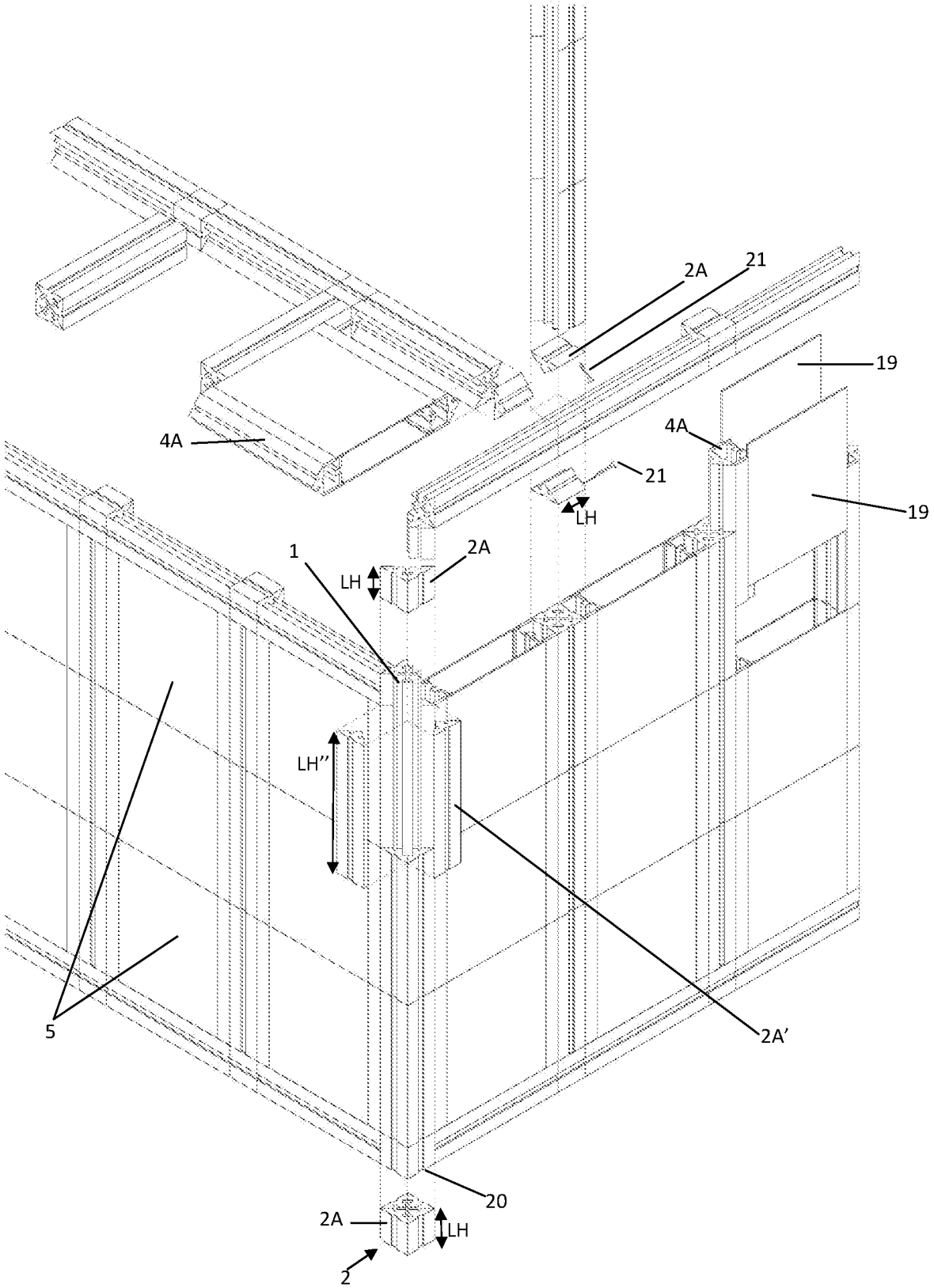
FIG. 5 represents a partial view of a construction module during assembly.

As illustrated in FIG. 5, the dwelling module 19 is being assembled with a majority of the elements which are assembled to each other by sliding one element relative to another but also by screwing using screws 21 such as for example to fasten a partial surrounding construction element 2A with a surrounding construction element 2, the partial surrounding construction element 2A being orthogonal to the surrounding construction elements 2 with which it is screwed.

According to a development of this embodiment of a module of a building 9, at least two opposite sides of the rectangular parallelepiped volume each include a plurality n of intermediate core construction elements 1 disposed vertically between the core construction elements 1 disposed at the corners. The intermediate core construction elements 1 support, on two opposite faces in the plane on the side of the module 9, junction parts 4A supporting n+1 panels 19.

As illustrated in FIG. 6 a module of a building 9 according to the invention, preferably comprises a floor or ceiling unit 19 comprising a rectangular frame formed of horizontally disposed elongated core construction elements 1, outwardly closed by partial surrounding portions 2A, 2A' and inwardly closed by junction parts 4A supporting a floor or ceiling.

Furthermore, doors and windows can be fitted in the walls of the modules 9 by changing the panels 19 carried by the junction elements 4A.

In a variant in FIGS. 5 and 6, in order to gain in strength, instead of the panels 19, it is envisaged to integrate a sandwich structure consisting of a PET foam placed between the PET panels. The sandwich structure increases the rigidity and the strength of the panel relative to the PET sheet in the initial version of FIGS. 5 and 6 only The PET foam core has a density of 70 kg/m3-80 kg/m3 and provides shearing as part of the sandwich constructions. In the wall sections, the foam core can be omitted to have windows.

The foam core is glued or welded on the interface parts.

A dwelling module according to the present invention has the advantage of being easy and quick to assemble and it is so robust that it meets the standards on the load-bearing structures such as the standard EN1991.

Figure 7A:
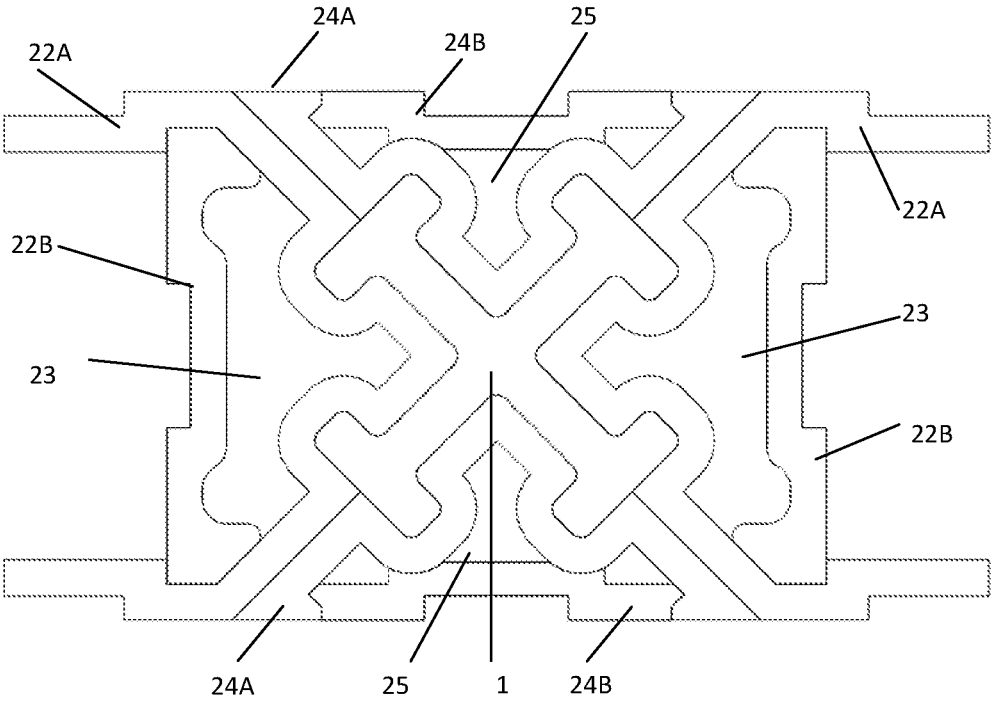
FIGS. 7A and 7B represent respectively a schematic section and a perspective view of a variant of a construction element.
Figure 7B:
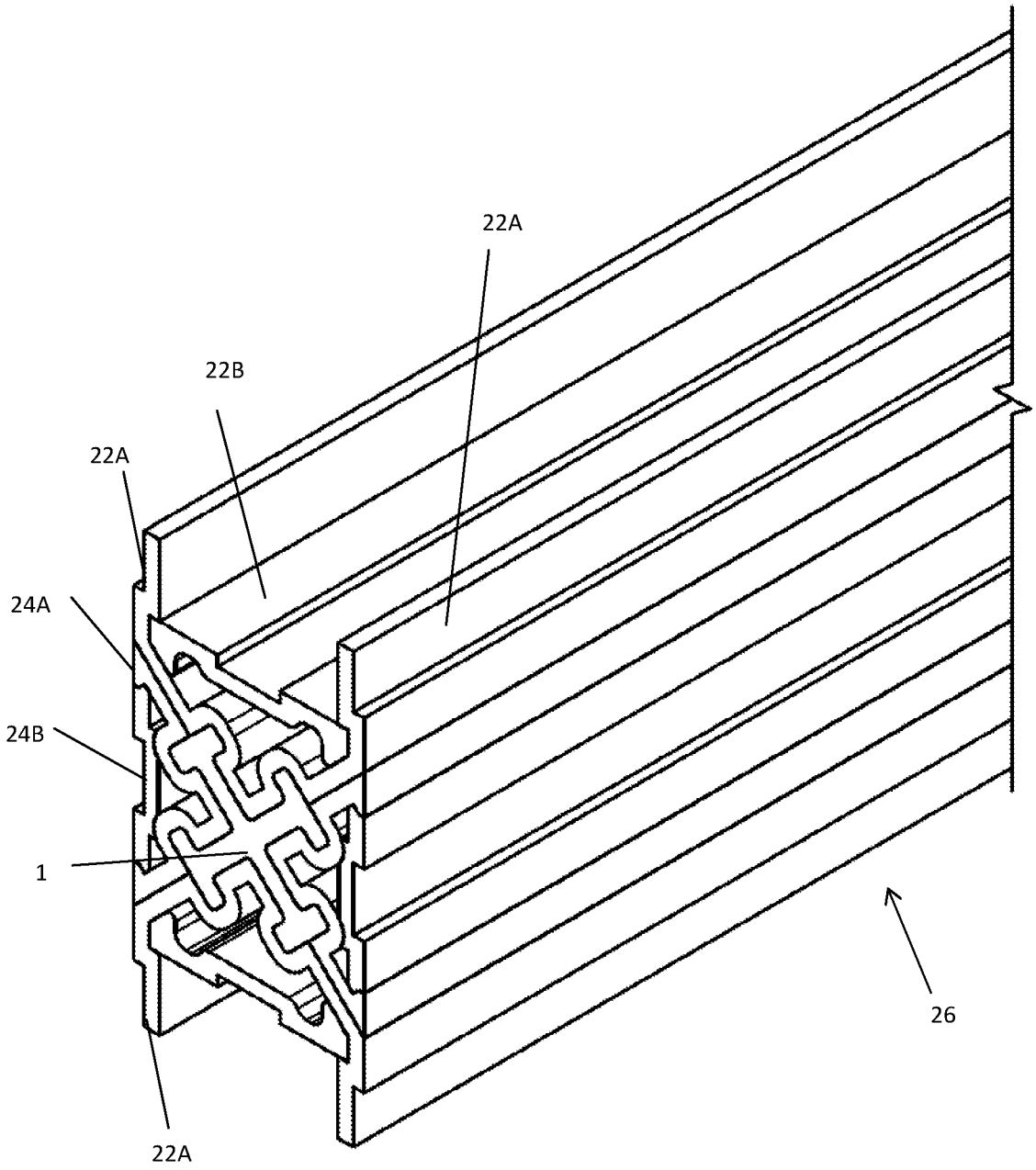

FIGS. 7A and 7B represent respectively a schematic section and a perspective view of a variant of a construction element in which each surrounding element is composed by the assembly of different parts.

FIG. 7A shows that a core element 1 in the form of a cross potent is surrounded by two partial surrounding parts, each 22A, 22B, and two partial surrounding parts, each 24A, 24B.

The parts 22A include profiled inner sections which conform to the outer shape of a part of the core element 1. The parts 22B are relatively flat with profiled ends which are engaged inside the parts 22A towards the ends thereof to define a void 23 between the parts 22A, 22B. The ends of the part 22*a* are bent and extend beyond the part 22B.

The parts 24A also include profiled inner sections which conform to the outer shape of another portion of the core element 1. The parts 24B are relatively flat, with a central groove in the outer face thereof, and with profiled ends which are engaged inside the ends of the parts 24A to define a void 25 between the parts 24A, 24B. The ends of the part 24A are profiled and are flush with the outer faces of the parts 22A and 24B.

The arrangement of the partial surrounding parts 22A, 22B and the partial surrounding parts 24A, 24B in an assembly according to the invention is illustrated in FIG. 7B. Note that the cross-shaped core element 1 includes arms of equal length and uniform thickness; the shape of the cross shown in FIG. 7B is the result of a distortion in the shot.

In this assembly, the surrounding portions extend along the length of the core element 1 to form a wall 26. This wall 26 is composed, from bottom to top, by the end of the part 22A, superimposed by the outer surface of the part 24A, superimposed by the part 24B with the outer groove thereof, superimposed by another outer surface of a part 24A and superimposed by another end of another part 22A, while this assembly is closed at the top and at the bottom, inside the walls 26, by part 22B disposed between the ends of the parts 22A.

Then, it is seen that the assembly, including a core element 1 surrounded by surrounding elements each formed by the assembly of several parts 22A, 22B, 24A, 24B, includes an outer wall 26 formed by an outer portion of the assembled parts disposed in parallel and adjacent rows extending along the outer wall 26.

This variant is particularly advantageous because the manufacture is simplified and the assembly more robust due to the fact that the partial surrounding parts of triangular section are cut into two parts and assembled, and due to the profiling of the different portions and the voids of different shapes.

In all embodiments, the term «plastic material» means any material which can be recycled (HDPE, LDPE, PP, PET, PS, ABS . . . ). Preferably, the recovered plastic parts can be crushed and shredded. Once shredded, plastic is washed then dried before being prepared for an extrusion operation. Polymers are melted by heat and a uniform paste is then obtained. After a succession of conventional steps, a grain is obtained. The granules are then extracted from the extruder. Finally, the grains can be used for the manufacture of the construction elements according to the present invention. Likewise, shredded, crushed and recycled wood or recycled plastic/wood composite materials can be used.

The construction elements can be manufactured by 3D printing or injection molding.

The invention claimed is:

1. A system for constructing a module of a building, including:

A plurality of core construction elements (1) which each include, in section, a cross including two main arms (6) of equal length, the main arms (6) intersecting at mid-length at a right angle, each core construction element (1) having a plane of symmetry about the axes of each main arm (6), A plurality of surrounding construction elements (2) of the core construction elements (1), each surrounding element (2) being composed of four partial surrounding parts (2A, 2B, 2A', 2B') which are assembled around a core element (1), The partial surrounding parts (2A, 2B, 2A', 2B') each have a section essentially of an isosceles right triangle including a long side (10) and two inclined sides (11) which form a right angle, the four partial surrounding parts (2A, 2B, 2A', 2B') once assembled are disposed with their long side (10) outwards and the inclined sides (11) terminating in the right angle inwards towards the center of the cross of a core element (1), thus forming a square surrounding the cross of the core construction element (1), Characterized in that the main arms (6) of the cross of each core construction core element (1) terminate at their ends by transversal parts (7) whose length is less than that of the main arms (6), and the triangular partial surrounding parts (2A, 2B, 2A', 2B') of the surrounding construction elements (2) include openings (12) and/or cutouts (13) that surround the principal arms and the transversal parts (7) of the cross of the core element (1).

2. The system according to claim 1, wherein the cross of a core construction element (1) is a cross potent whose main arms (6) are terminated, at the ends thereof, with T-shaped transverse projections (7).

3. The system according to claim 1, wherein the cross has a dimension L in the direction of the main arms, the lateral projections have a length t, and the ratio L:t=2.5-3, preferably 2.6-2.75.

4. The system according to claim 2, wherein the main arms (6) and the T-shaped transverse projections (7) of the cross potent have a uniform thickness e, and wherein:

the length t=(1.5-4)e, preferably (2.5-3.5)e, for example 3e, the dimension L=(6-10)e, preferably (7-9)e, for example 8e.

5. The system according to claim 1, including surrounding construction elements (2) each composed of four partial surrounding parts (2A, 2B, 2A', 2B') which have cutouts (13) in the inclined sides (11) thereof so that the cutouts of two side-by-side triangular partial surrounding parts (2A, 2B, 2A', 2B') correspond to a main arm (6) of the cross with its possible transverse projections (7) so that the arms of the cross are disposed along the diagonals of the square formed by the four assembled partial surrounding parts (2A, 2B, 2A', 2B').

6. The system according to claim 1, including surrounding construction elements (2) each composed of four triangular-shaped partial surrounding parts (2A, 2B, 2A', 2B') which each have, inside each triangular partial surrounding part, openings (12) in the shape of a main arm (6) of the cross extending from the right angle of the triangle with its transverse projections (7) in front of the long side (10) of the triangle so that the main arms (6) of the cross and the T-shaped projections (7) are disposed parallel to the sides of the square formed by the four assembled partial surrounding parts (2A, 2B, 2A', 2B').

7. The system according to claim 1 including surrounding construction elements each formed of a single part, possibly with one or several opening(s) in this part.

8. The system according to claim 1, including surrounding construction elements each formed by the assembly of two or several part(s) (22A, 22B; 24A, 24B) leaving one or several opening(s) (23, 25).

9. The system according to claim 8, assembled in an assembly including a said core construction element (1) that is surrounded by surrounding construction elements each formed by the assembly of several parts (22A, 22B; 24A, 24B), the assembly including an outer wall (26) formed by outer portions of the assembled parts (22A, 22B; 24A, 24B) disposed in parallel and adjacent rows that extend along and form the outer wall (26).

10. The system according to claim 1, including a plurality of said core construction elements (1) and a plurality of said surrounding construction elements (2A, 2B) of the core elements (1), each in a standard length or in several standardized lengths.

11. The system according to claim 1, including a plurality of said core construction elements forming junction parts (4A, 4B) including a hollow body (15) of an approximately rectangular shape in section, one side of this hollow body (15) being secured with a triangular shape (16) which corresponds with one of said triangular-shaped partial surrounding portions (2A, 2B, 2A', 2B') of the surrounding construction elements (2), allowing these junction parts (4A, 4B) to be assembled around a core construction element (1).

12. The system according to claim 11, including, on an outer side (17) of the hollow body (15) of a junction part (4A, 4B) opposite to said one side which is secured with the triangular shape, a profile (18) adapted for the assembly of a panel (19).

13. A module of a building constructed with a plurality of core construction elements (1) assembled with partial surrounding parts (2A, 2B, 2A', 2B') and junction parts (4A, 4B) of a system according to claim 1.

14. The module of a building according to claim 13, in the form of a rectangular parallelepiped volume comprising four corners (20), each corner (20) comprising a vertically disposed core construction element (1), two faces of which, forming an external right angle at the corner, are closed by partial surrounding parts (2A, 2B, 2A', 2B') of the surrounding construction elements, and two faces of which forming an internal right angle are assembled with junction parts (4A, 4B), the outer sides of said hollow body of the junction parts supporting panels (19) forming a facade.

15. The module of a building according to claim 14, wherein at least two opposite sides of the rectangular parallelepiped volume each include a plurality n of intermediate core construction elements (1) disposed vertically between the core construction elements (1) disposed at the corners (20), the intermediate core construction elements (1) supporting n+1 panels (19) on two opposite faces in the plane on the side of the junction parts (4A, 4B).

16. The module of a building according to claim 14, including a floor or ceiling unit (19) comprising a rectangular frame formed of horizontally disposed elongated core construction elements (1), outwardly closed by partial surrounding parts (2A, 2B, 2A', 2B') and inwardly closed by junction parts (4A, 4B) supporting a floor or ceiling.

* * * * *